US011391034B2

(12) United States Patent
Sato

(10) Patent No.: US 11,391,034 B2
(45) Date of Patent: Jul. 19, 2022

(54) INSTALLATION AND CONSTRUCTION METHOD OF WALL PANEL

(71) Applicant: SEKISUI HOUSE, LTD., Osaka (JP)

(72) Inventor: Ryousuke Sato, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 0 days.

(21) Appl. No.: 16/970,432

(22) PCT Filed: Jan. 22, 2020

(86) PCT No.: PCT/JP2020/002033
§ 371 (c)(1),
(2) Date: Aug. 17, 2020

(87) PCT Pub. No.: WO2020/158525
PCT Pub. Date: Aug. 6, 2020

(65) Prior Publication Data

US 2021/0222420 A1 Jul. 22, 2021

(30) Foreign Application Priority Data

Jan. 30, 2019 (JP) ..... JP2019-014150

(51) Int. Cl.
*E04B 1/26* (2006.01)
*E04C 2/38* (2006.01)

(52) U.S. Cl.
CPC .... *E04B 1/2604* (2013.01); *E04B 2001/2648* (2013.01); *E04B 2001/2652* (2013.01); *E04C 2/38* (2013.01)

(58) Field of Classification Search
CPC ..... E04B 1/2604; E04B 1/2608; E04B 2001/2648; E04B 2001/2652;
(Continued)

(56) References Cited

U.S. PATENT DOCUMENTS 5,438,811 A * 8/1995 Goya ..... E04B 1/2604 52/702
5,921,049 A * 7/1999 Sugiyama ..... E04B 1/2604 52/653.1
(Continued)

FOREIGN PATENT DOCUMENTS

JP 6-158753 A 6/1994
JP 2003049481 A * 2/2003
(Continued)

OTHER PUBLICATIONS

Machine translation of foreign reference JP6383891, obtained from https://www.j-platpat.inpit.go.jp/p0200, last accessed on May 6, 2021) (Year: 2021).*

*Primary Examiner* — Theodore V Adamos
(74) *Attorney, Agent, or Firm* — McClure, Qualey & Rodack, LLP

(57) ABSTRACT

Installation and construction methods for installing a wall panel are provided. The wall panel includes a surface member and a long joint member that extends horizontally, is fixed to one plate surface of the surface member, and is joined to a pair of wooden columns. The method includes: disposing the joint member between the pair of wooden columns; joining both longitudinal ends of the joint member to respective side surfaces, facing each other, of the pair of wooden columns; installing the wooden beam between the pair of wooden columns and adjusting erection of the wooden columns; and fixing an edge of the surface member to front surfaces of the pair of wooden columns and the wooden beam.

7 Claims, 13 Drawing Sheets

(58) Field of Classification Search
CPC ..... E04B 2001/262; E04B 2001/2628; E04B 2001/2636; E04B 2/7457; E04C 2/38; E04H 9/02
See application file for complete search history.

(56) References Cited

U.S. PATENT DOCUMENTS 6,032,431 A * 3/2000 Sugiyama ..... F16B 9/058 52/656.9
6,067,769 A * 5/2000 Hardy ..... E04C 3/02 52/295
6,158,184 A * 12/2000 Timmerman, Sr. ... E04B 1/0007 52/293.3
6,240,695 B1 * 6/2001 Karalic ..... E04C 3/02 52/656.1
9,920,531 B1 * 3/2018 Charest ..... E04C 3/12
2001/0002529 A1 * 6/2001 Commins ..... E04B 1/26 52/481.1
2002/0020122 A1 * 2/2002 Mueller ..... E04H 9/0237 52/167.3
2002/0108332 A1 * 8/2002 Timmerman, Sr. ... E04B 1/0007 52/293.3
2003/0041551 A1 * 3/2003 Boone ..... E04B 1/26 52/698
2004/0200178 A1 * 10/2004 Simmons ..... E04B 1/24 52/633
2013/0025222 A1 * 1/2013 Mueller ..... E04C 2/384 52/293.3
2013/0028657 A1 * 1/2013 Kenho ..... E04B 1/2604 403/188
2018/0127969 A1 * 5/2018 Acquistapace ..... E04B 1/26
2018/0127971 A1 * 5/2018 Holland ..... E04B 1/2612

FOREIGN PATENT DOCUMENTS

JP 6383891 B1 8/2018
WO WO-2020158526 A1 * 8/2020 ..... E04C 2/38

* cited by examiner

[FIG. 1]
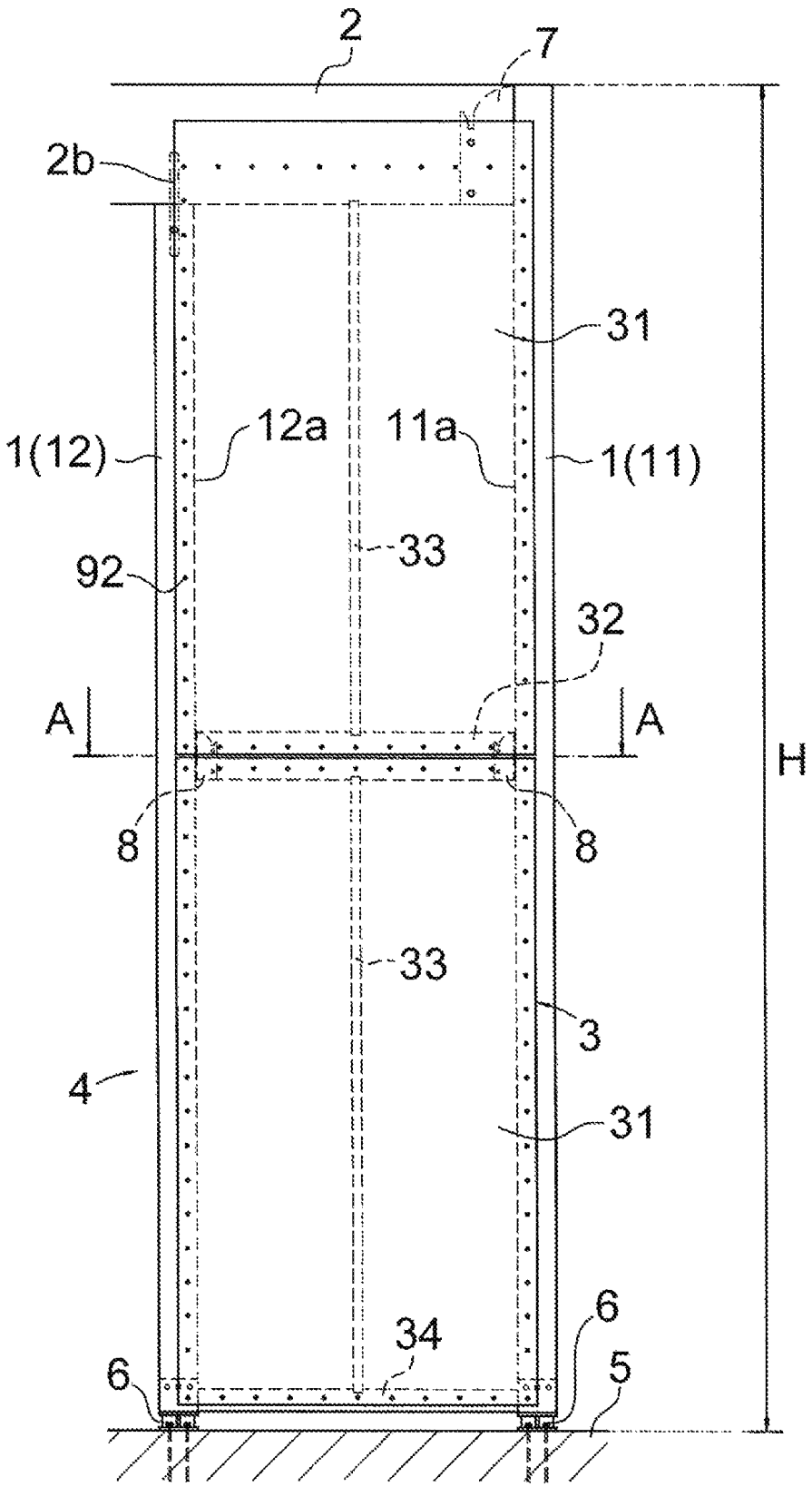

[FIG. 2]
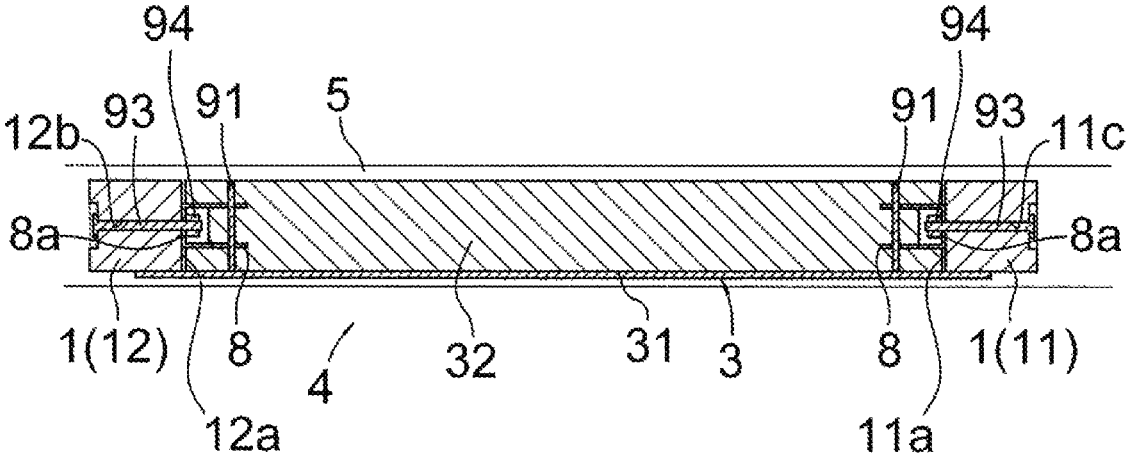

[FIG. 3A]
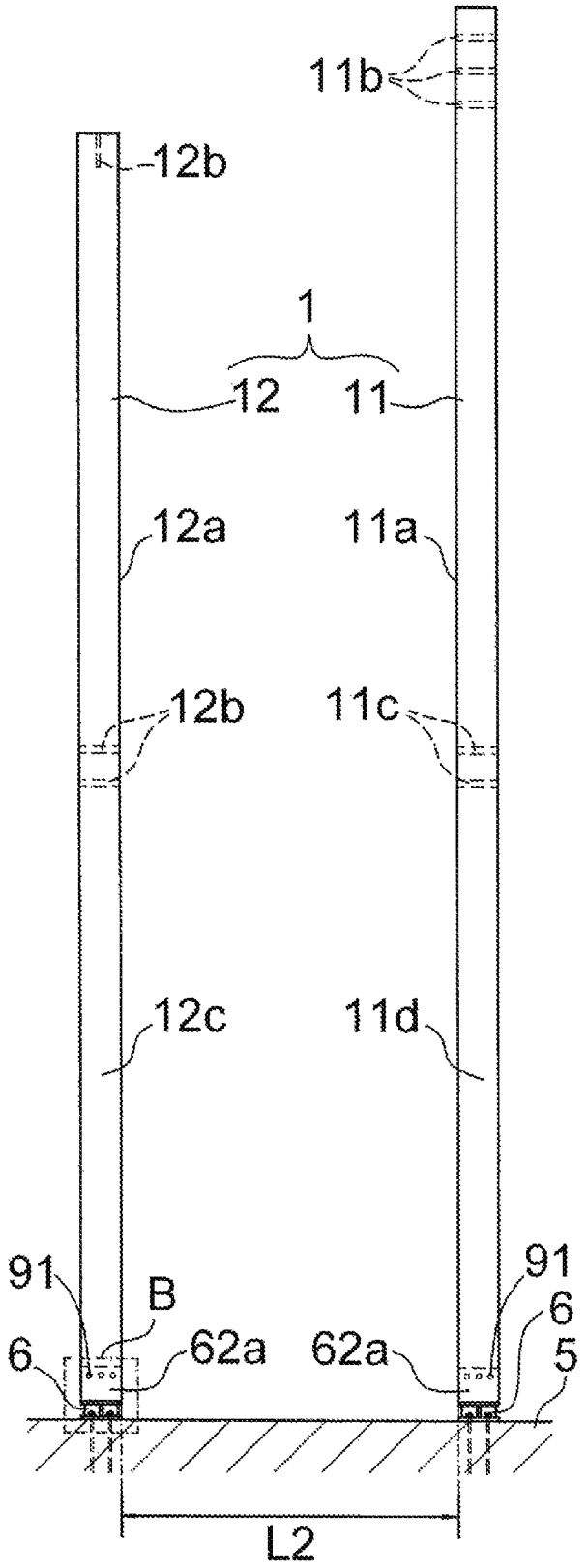

[FIG. 3B]
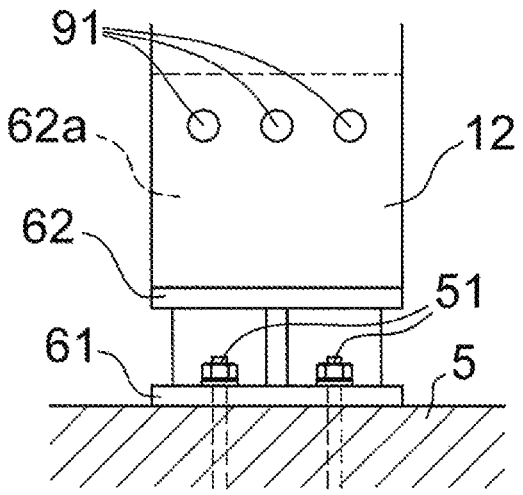

[FIG. 4]
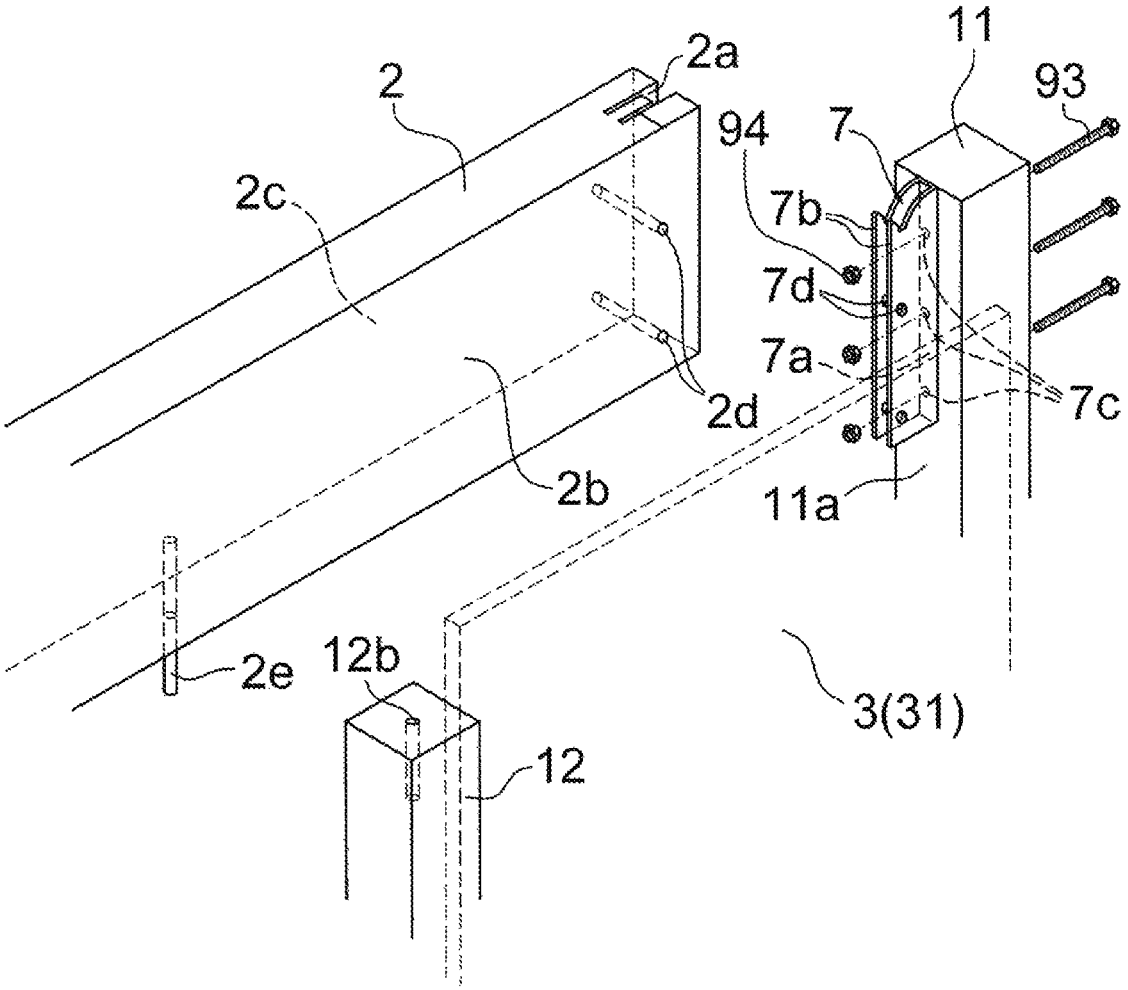

[FIG. 5]
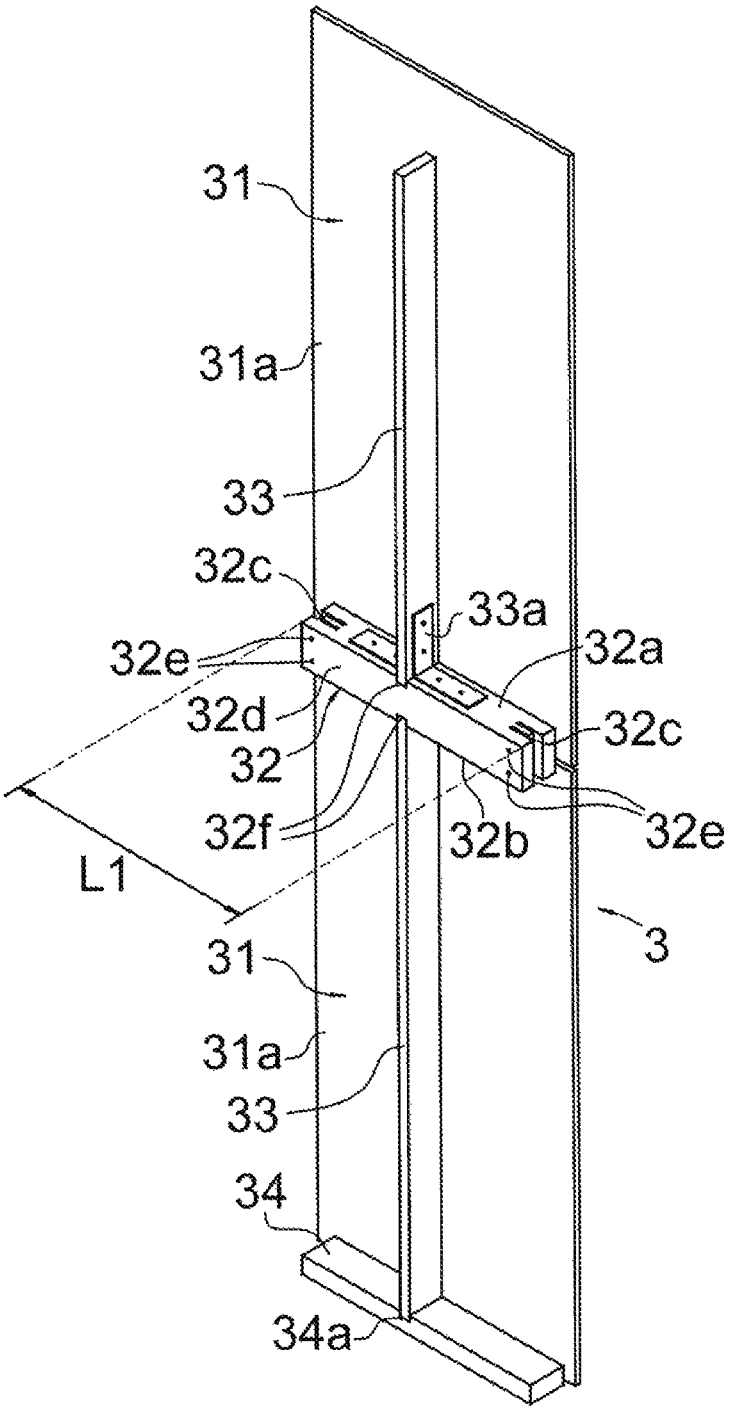

[FIG. 6]
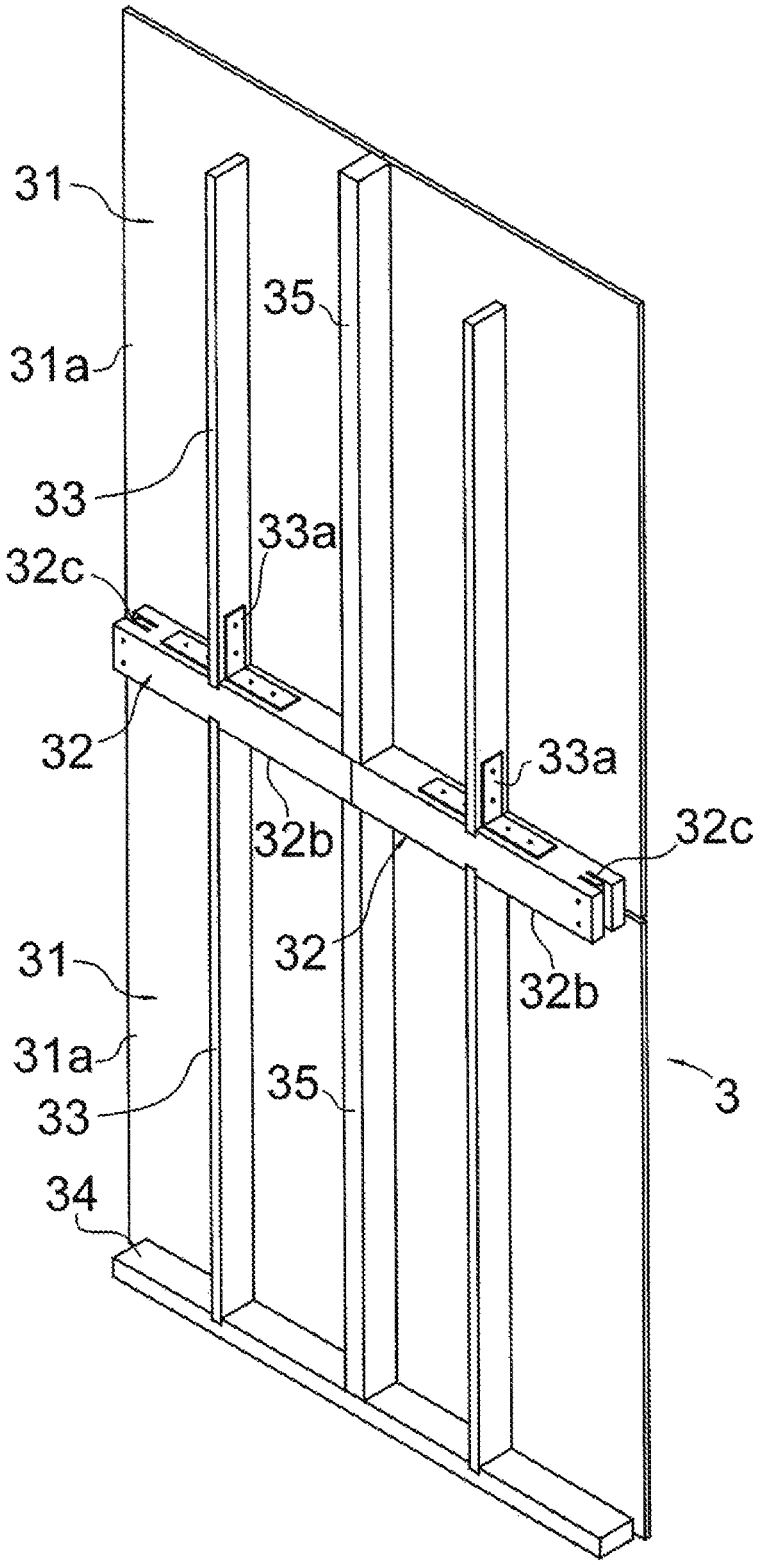

[FIG. 7A]
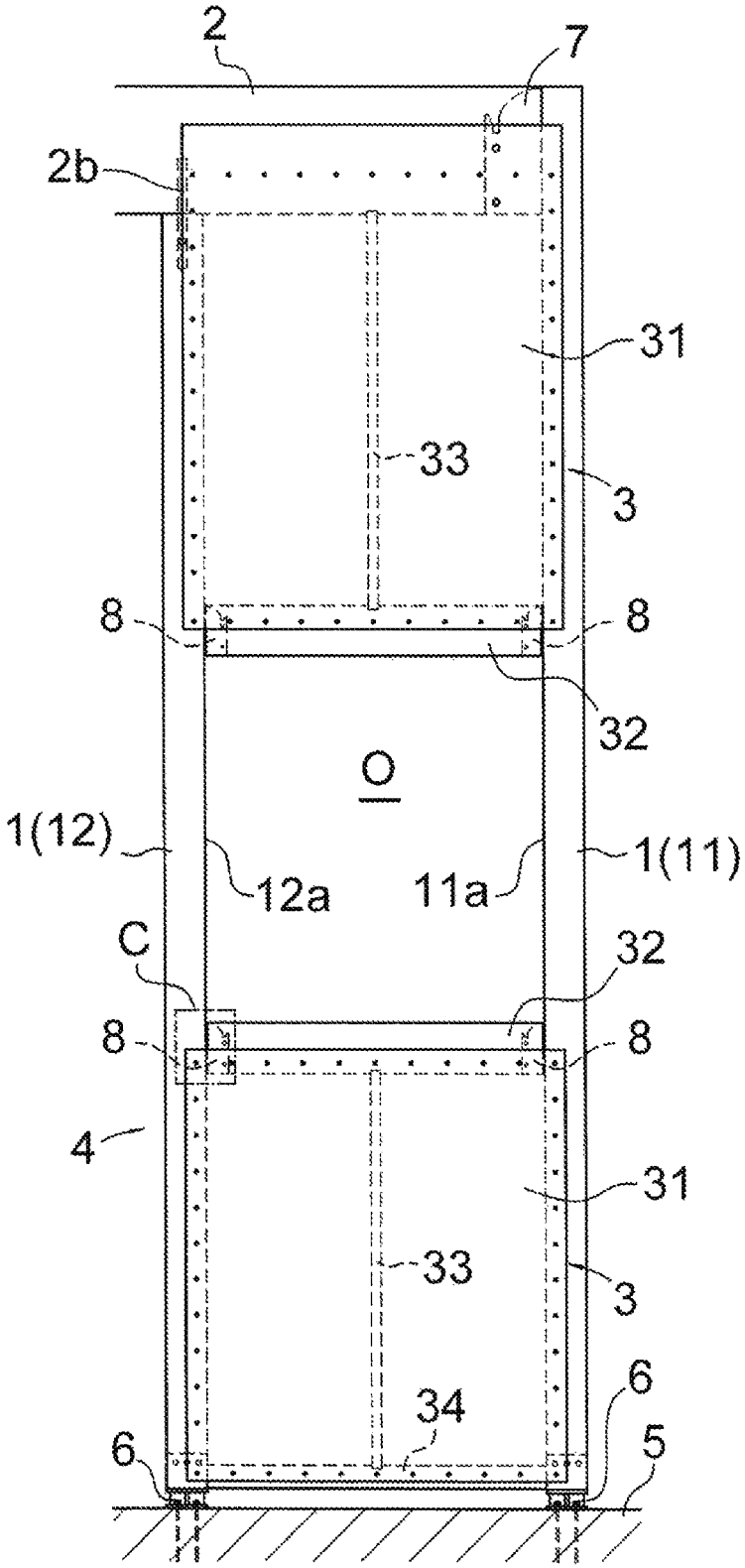

[FIG. 7B]
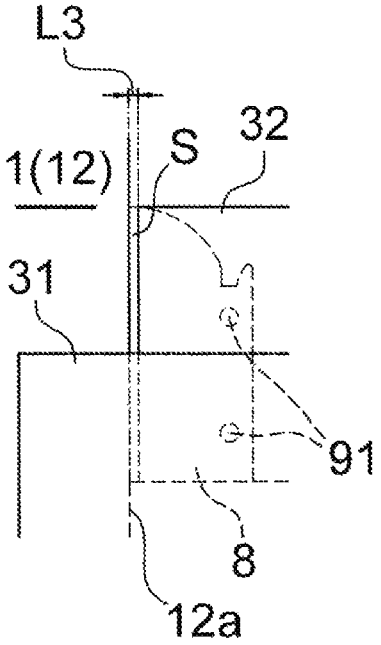

[FIG. 8]
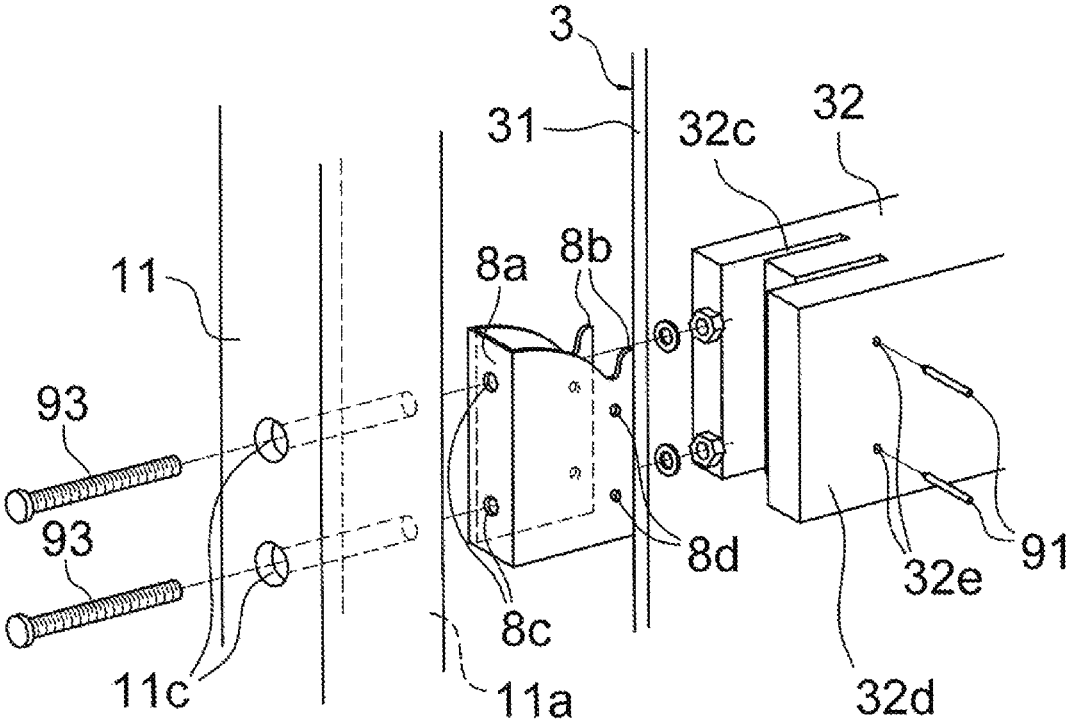

[FIG. 9]
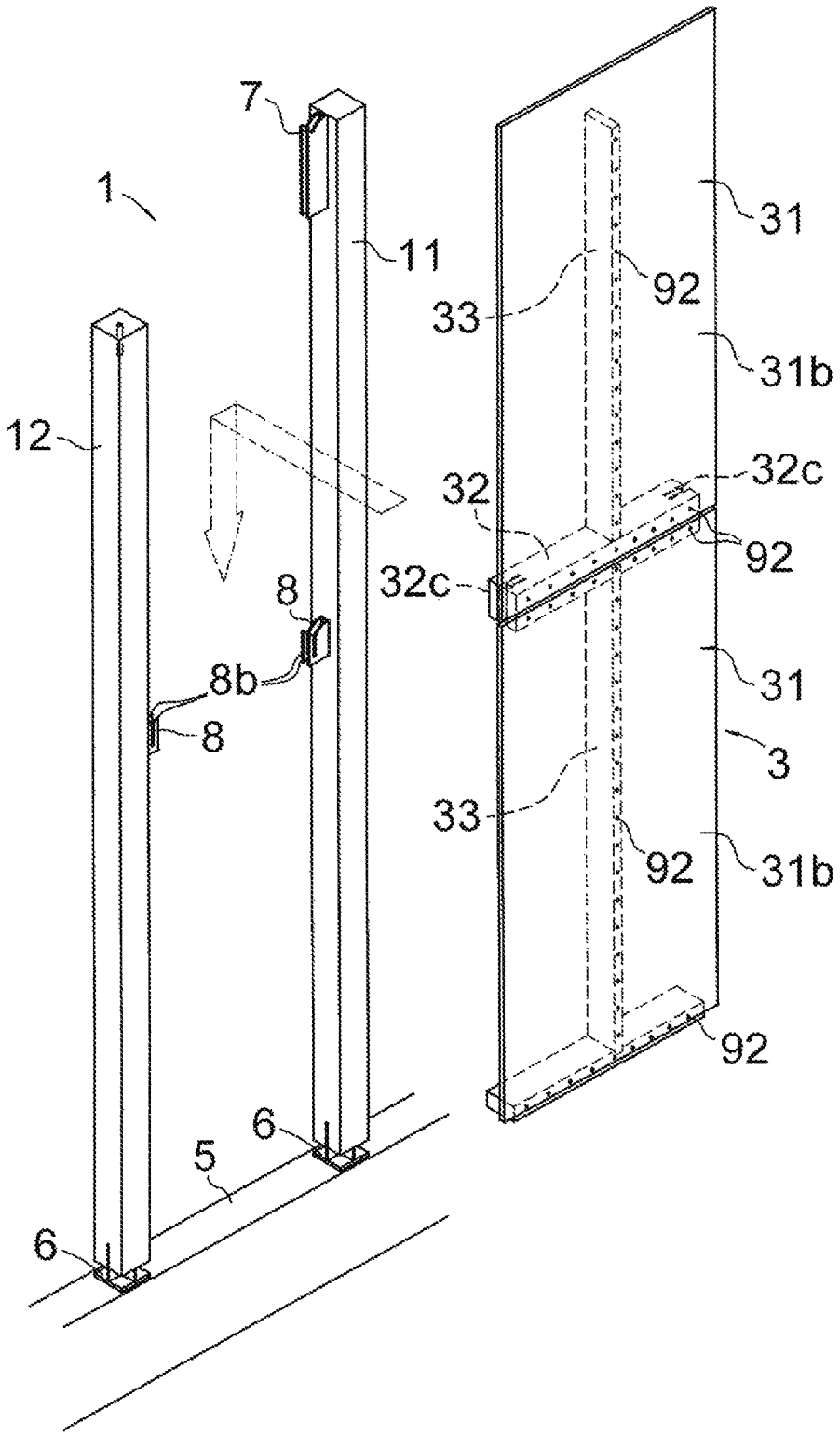

[FIG. 10]
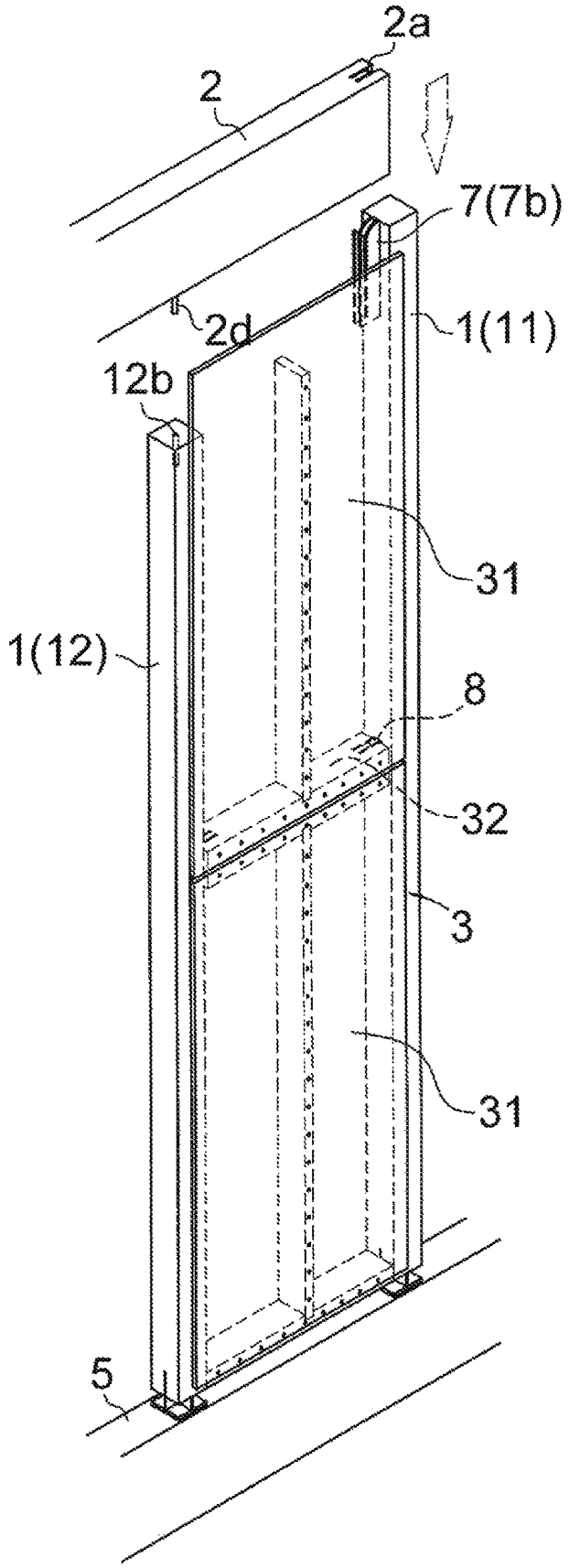

[FIG. 11]
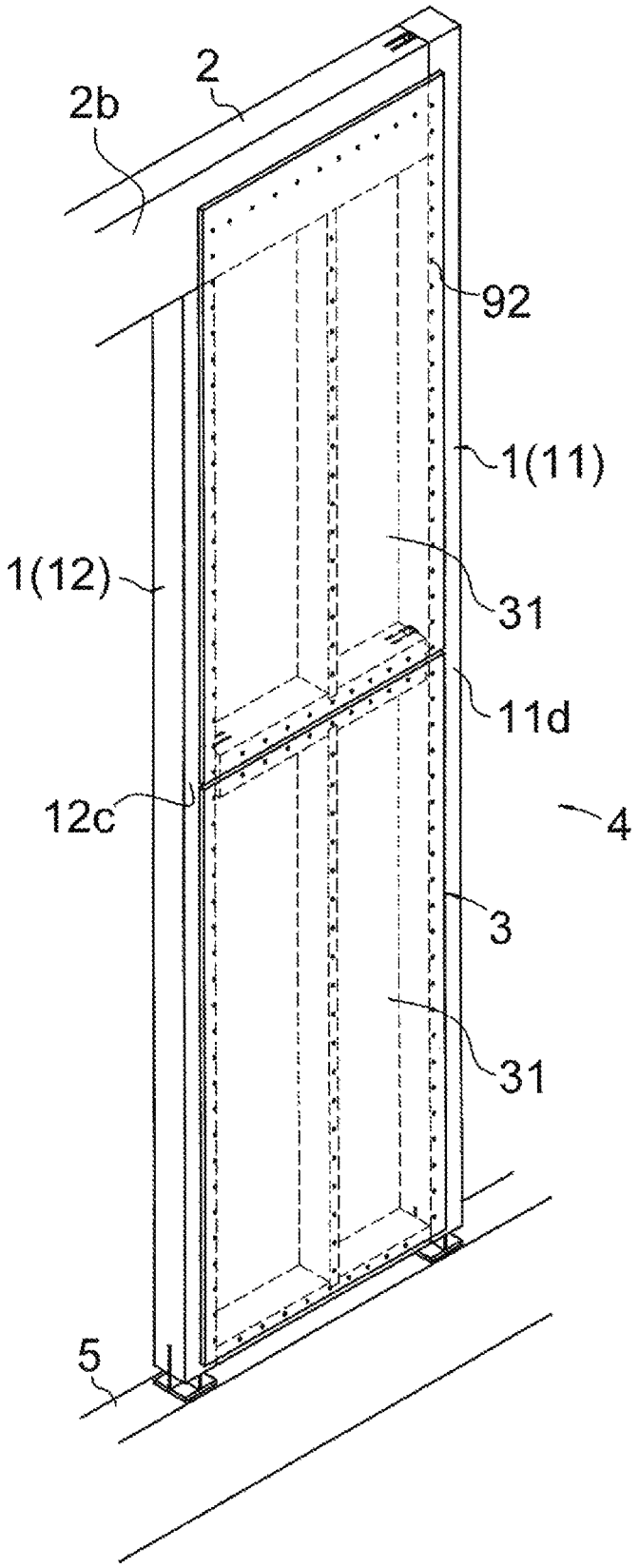

INSTALLATION AND CONSTRUCTION METHOD OF WALL PANEL

TECHNICAL FIELD

The present invention relates to an installation and construction method of a wall panel for installing the wall panel to a framework member, which is constituted of a pair of wooden columns and a wooden beam, in a wooden framework construction method.

BACKGROUND ART

Conventionally, as bearing walls in wooden framework structures, there have been generally used bearing walls, each of which is formed by obliquely laying bracings to a framework member formed by installing a wooden beam to a pair of wooden columns; and bearing walls, each of which is formed by integrating a framework member and a bearing surface member such as structural plywood. In general, when the bearing wall in which the framework member and the bearing surface member are integrated is formed, the formation of the bearing wall is conducted in the following procedure: the framework member is formed by installing a wooden beam to the wooden columns; erection adjustment of the wooden columns is conducted; thereafter, the so-called common lumbers such as studs serving as a substrate member of the bearing surface member are installed to the framework member; and finally, the bearing surface member is fixed to the common lumbers and the framework member. On the other hand, there has been proposed a bearing wall structure which is formed by carrying a wall panel, in which common lumbers and a bearing surface member are previously integrated, in a construction site and directly fixing the wall panel to a framework member (for example, Patent Literatures 1 and 2).

CITATION LIST

Patent Literature

Patent Literature 1: JP 2016-125201 A
Patent Literature 2: JP 2010-121338 A

SUMMARY OF THE INVENTION

Technical Problems

Incidentally, when the common lumbers and the bearing surface member are separately installed to the framework member, since it takes time to form the framework member, the construction of the common lumbers and the bearing surface member is usually conducted over two consecutive days from a construction date of the framework member. In addition, it is often the case that installation of the common lumbers and the bearing surface member which can be constructed in a manner of a post-construction is left until later, and in many cases, after the framework member has been formed and the erection adjustment work of the wooden columns has been conducted, priority is given to construction of an upstairs floor and formation of an upstairs framework member. However, since the construction of the common lumbers and the bearing surface member is conducted outdoors as with the construction of the framework member, the construction of the common lumbers and the bearing surface member is susceptible to weather, and when the construction of the common lumbers and the bearing surface member is conducted separately from the construction of the framework member, it is likely that the whole processes are influenced and a construction period is thereby extended. Furthermore, in a case of a framework panel construction method in which the framework member, the common lumbers, and the bearing surface member are integrated, frame conditions of the wooden beam of the framework member are frequently limited, which may be a cause to obstruct a projecting beam installed to configure a deep space under eaves. In order to address the above-described problems, a wall panel which is separated from the framework member and is constituted of only the common lumbers and the bearing surface member is used, so that a wall composite construction method, which causes no limitations on structural surfaces of the wooden beam constituting a floor slab and a roof, can be attained.

In addition, in the wall panel described in each of Patent Literatures 1 and 2, since the bearing surface members and the common lumbers are previously integrated, the bearing surface members and the common lumbers can be easily fixed to the framework member, and working hours can be shortened. However, when erection adjustment of the wooden columns of the framework member is attempted after fixation to the wall panel, movement of the framework member is often obstructed by the wall panel, and the adjustment is thereby inhibited from being smoothly conducted.

Hence, in view of the above-described problems, the present invention has been devised. It is an object of the present invention to provide an installation and construction method of a wall panel, in which the wall panel can be easily installed to a framework member formed by installing a wooden beam to a pair of wooden columns and erection of the wooden columns is not susceptible.

Solutions to the Problems

A first wall panel installation and construction method according to the present invention is an installation and construction method of a wall panel for installing the wall panel on a pair of wooden columns erected with a distance from each other and a wooden beam installed between the pair of wooden columns, the wall panel including a surface member and a long joint member that extends horizontally, is fixed to one plate surface of the surface member, and is joined to the pair of wooden columns, the wall panel installation and construction method comprising:

disposing the joint member between the pair of wooden columns;

joining both longitudinal ends of the joint member to respective side surfaces, facing each other, of the pair of wooden columns;

installing the wooden beam between the pair of wooden columns and adjusting erection of the wooden columns; and fixing an edge of the surface member to front surfaces of the pair of wooden columns and the wooden beam.

A second wall panel installation and construction method according to the present invention, wherein a joint metal fitting is fixed to each of the side surfaces, facing each other, of the pair of wooden columns, and the joint member is joined to the pair of wooden columns by inserting an insertion portion of the joint metal fitting into each of cut grooves formed at both longitudinal ends of the joint member, and penetrating the joint member with a drift pin along with the insertion portion.

A third wall panel installation and construction method according to the present invention, wherein the wall panel is formed by connecting and fixing each of the surface members, adjacent vertically, with the joint member.

A fourth wall panel installation and construction method according to the present invention, wherein the wall panel is formed by fixing the joint member to an upper end or a lower end of the surface member, and the joint member is joined by the joint metal fitting with each longitudinal end of the joint member spaced by a predetermined distance from each of the side surfaces, facing each other, of the pair of wooden columns.

A fifth wall panel installation and construction method according to the present invention, wherein the cut groove is formed to penetrate the joint member from an upper end surface to a lower end surface of the joint member.

A sixth wall panel installation and construction method according to the present invention, wherein the wall panel further includes a stud and a lower frame member that are fixed to a plate surface of the surface member on a side where the joint member is fixed and reinforce the surface member.

In accordance with a first wall panel installation and construction method according to the present invention, since the wall panel installation and construction method comprises disposing the joint member of a wall panel between the pair of wooden columns, installing the wooden beam on the condition of joining both longitudinal ends of the joint member to respective side surfaces, facing each other, of the pair of wooden columns, adjusting erection of the wooden columns, and then fixing an edge of the surface member to front surfaces of the wooden columns and the wooden beam, adjusting erection of the wooden columns can be smoothly conducted without the movement of the wooden columns and the wooden beam being obstructed by the wall panel. In addition, since the framing of the wooden columns and the wooden beams, the erection adjustment of each of the wooden columns, and the construction of the wall panel can be performed at the same timing, the outdoor work time easily affected by weather can be shortened.

In accordance with a second wall panel installation and construction method according to the present invention, since a joint metal fitting is fixed to each of the side surfaces, facing each other, of the pair of wooden columns, and the joint member is joined to the pair of wooden columns by inserting an insertion portion of the joint metal fitting into each of cut grooves formed at both longitudinal ends of the joint member, The marking work for the joint member to dispose the installation position to the wooden columns is not necessary, the joint member can be joined to the pair of wooden columns by disposing the wall panel which is a heavy member in an appropriate position, and workability can be enhanced.

In accordance with a third wall panel installation and construction method according to the present invention, since the wall panel is formed by connecting and fixing each of the surface members, adjacent vertically, with the joint member, the wall panel can be corresponded to a floor height by jointed the surface members to adjacent vertically.

In accordance with a forth wall panel installation and construction method according to the present invention, since the wall panel is formed by fixing the joint member to an upper end or a lower end of the surface member, the joint member can be used as a window sill or a window lintel when the opening is formed in the upper end or the lower end of the wall panel between the pair of wooden columns. Furthermore, the joint member is joined by the joint metal fitting with each longitudinal end of the joint member spaced by a predetermined distance from each of the side surfaces, facing each other, of the pair of wooden columns, a horizontal force acts on the pair of wooden columns, and when the part of the wooden columns which faces the opening and to which the surface member is not fixed has a larger amount of displacement in a horizontal direction than the part of the wooden columns to which the surface member is fixed, the part of the wooden columns which faces the opening and to which the surface member is fixed reduce the possibility to buckle in a brittle manner because a large amount of shear compressive force is transmitted to a part intersecting with the joint member.

In accordance with a fifth wall panel installation and construction method according to the present invention, since the cut groove is formed to penetrate the joint member from an upper end surface to a lower end surface of the joint member, the joint member can be easily inserted the insertion portion into the cut groove only by being dropped from above the joint metal fitting.

In accordance with a sixth wall panel installation and construction method according to the present invention, since the wall panel includes a stud and a lower frame member, so-called common lumbers that reinforce the surface member, it is not necessary to construct the surface member and common lumbers indivisuary in a construction site, therefore, workability can be enhanced.

BRIEF DESCRIPTION OF THE DRAWINGS

FIG. 1 is a front view showing a bearing wall.

FIG. 2 is a sectional view of A-A in FIG. 1.

FIG. 3A is a front view showing a pair of wooden columns.

FIG. 3B is an enlarged sectional view of a portion B in FIG. 3A.

FIG. 4 is a perspective view showing a wooden beam and a first joining metal fitting.

FIG. 5 is a perspective view showing a wall panel.

FIG. 6 is a perspective view showing a state in which a wall panel is connected in a horizontal direction.

FIG. 7A is a front view showing a bearing wall in which an opening is provided.

FIG. 7B is an enlarged front view of a portion C in FIG. 7A.

FIG. 8 is a perspective view showing a second joining metal fitting.

FIG. 9 is a perspective view showing a state in which a wall panel is joined to the second joining metal fitting.

FIG. 10 is a perspective view showing a state in which the wooden beam is joined to the pair of wooden columns.

FIG. 11 is a perspective view showing a state in which a surface member is fixed to the wooden beam and the pair of wooden columns.

DESCRIPTION OF EMBODIMENTS

Hereinafter, embodiments of an installation and construction method of a wall panel according to the present invention will be described with reference to the accompanying drawings. The installation and construction method of the wall panel in the present application is a construction method used when an architectural structure having a wooden framework structure is built, wherein as illustrated in FIG. 1, is used to install a wall panel 3 to a framework member formed by installing a wooden beam 2 to a pair of wooden columns 1 and is mainly used to install the wall panel to a framework member located in a first floor outer peripheral portion of the architectural structure to form a bearing wall. It is to be noted that the installation and construction method of the wall panel in the present application is used not only in a case where the bearing wall of a building outer peripheral portion is formed but also in a case where a bearing wall or a normal partition wall inside a building is formed, and furthermore, the installation and construction method of the wall panel therein can be used for a bearing wall or a partition wall which is formed on a second or further upper floor, not limited for the bearing wall or the partition wall formed on the first floor. In each of the present embodiments, a case where a bearing wall 4 of an outer peripheral portion on a building first floor will be described. In addition, in the present application, a "front surface" is a surface which is visible and a "rear surface" is a surface on a side opposite to the "front surface" in FIG. 1.

As illustrated in FIGS. 1 and 2, the bearing wall 4 is formed by fixing the wall panel 3, obtained by connecting and fixing a plurality of surface members 31 with a joint member 32, to a framing member made up of the wooden beam 2 and the pair of wooden columns 1 erected on the upper part of a foundation 5 with a distance therebetween.

As illustrated in FIG. 3A, the pair of wooden columns 1 are long vertical members erected on the upper end surface of the foundation 5 through column base metal fittings 6 fixed to the lower ends of the wooden columns 1. Of the pair of wooden columns 1, one wooden column 11 is formed longer than the other wooden column 12. While a plurality of first through holes 11*b*, which penetrate from a first side surface 11*a* facing the other wooden column 12 toward the side surface on the opposite side of the first side surface 11*a*, are formed at the upper end, a plurality of second through holes 11*c*, which also penetrate from the first side surface 11*a* toward the side surface on the opposite side of the first side surface 11*a*, are formed at substantially the longitudinal center. In the other wooden column 12, a plurality of third through holes 12*b*, which penetrate from a second side surface 12*a* facing the one wooden column 11 toward the side surface opposite to the second side surface 12*a*, are formed at a height matching the second through holes 11*c*. Further, a dowel hole 12*b* extending from the upper end surface to the lower end surface is formed in the other wooden column 12. By inserting a dowel 2*e* of the wooden beam 2 to be described later into the dowel hole 12*b*, the wooden beam 2 can be locked to the other wooden column 12.

As illustrated in FIG. 3B, the column base metal fitting 6 is made up of a pedestal 61 that is fixed to the foundation 5 with an anchor bolt 51 projecting from the upper end surface of the foundation 5, and a support 62 that supports the lower end of each of the wooden columns 11, 12 (the other wooden column 12 in the illustrated example). The column base metal fitting 6 is fixed integrally with each of the wooden columns 11, 12 by inserting an insertion plate 62*a* of the support 62, which projects upward as illustrated in FIG. 3A, into a cut groove (not illustrated) formed in the lower end of each of the wooden columns 11, 12, and penetrating each of the wooden columns 11, 12 and the insertion plate 62*a* with a doft pin 91.

The wooden beam 2 installed between the pair of wooden columns 1 illustrated in FIG. 1 is a long horizontal member extending horizontally, and is made of a floor beam supporting an upper floor, a roof beam supporting a roof, or the like. As illustrated in FIG. 4, one longitudinal end of the wooden beam 2 can be joined to the one wooden column 11 with a first joint metal fitting 7 fixed to the one wooden column 11. The one longitudinal end is formed with a first cut groove 2*a* having a substantially U-shape in a plan view, formed from one end toward the other end so as to be engaged with the first joint metal fitting 7, and a fourth through hole 2*d* penetrating from a first front surface 2*b* to a first back surface 2*c* side opposite to the first front surface 2*b*. To the lower end surface of the wooden beam 2 in contact with the other wooden column 12, a bar-shaped dowel 2*e* projecting downward from the lower end surface is fixed. By inserting the dowel 2*e* into the dowel hole 12*b* of the other wooden column 12, the wooden beam 2 can be locked to the other wooden column 12. In the present embodiment, the frame with the one wooden column 11 set on the wooden beam 2 is formed, but there is no particular limitation, and a frame with the wooden beam 2 set on both the wooden columns 11, 12 may be formed.

As illustrated in FIG. 1, the wall panel 3 is a panel member installed over the entire range surrounded by the pair of wooden columns 1 and the wooden beam 2. As illustrated in FIG. 5, the wall panel 3 includes: two surface members 31; a long joint member 32 vertically connecting the surface members 31 and extending horizontally; and a stud 33 and a lower frame member 34 that are fixed to one plate surface 31*a* of each of the surface members 31 and serve as a base member for the surface member 31. The wall panel 3 is carried into a construction site with these members having been assembled in advance at a factory. For the surface member 31, a plate member such as structural plywood or particle board having excellent shearing performance is used, and the surface member 31 is formed to have a width of about 900 to 1000 mm and a height of about 3030 mm or less. Since the surface members 31 can be made into a panel corresponding to a floor height H of various heights illustrated in FIG. 1 by being vertically connected to each other with the joint member 32, the wall panel 3 can be formed using structural plywood or particle board of a general standard size, and can be made into a panel member excellent in convenience and economy. As illustrated in FIG. 1, the two surface members 31 connected and fixed with the joint member 32 cover respective front surfaces 11*d*, 12*c* of the pair of wooden columns 1 and a part of a front surface 2*d* of the wooden beam 2 and are fixed with locking tools 92 such as screws or nails.

As illustrated in FIGS. 5 and 9, the joint member 32 is disposed on the one plate surface 31*a* across the lower end of the upper surface member 31 and the upper end of the lower surface member 31, and is fixed to each surface member 31 from the other plate surface 31*b* side with locking tools 92. Further, the surface members 31 vertically adjacent to each other are connected to the joint member 32 with an interval of about 10 mm. In the joint member 32, both longitudinal ends can be joined to the pair of wooden columns 1 with second joint metal fittings 8 that is fixed to the pair of wooden columns 1 illustrated in FIG. 1. As illustrated in FIG. 5, second cut grooves 32*c* and fifth through holes 32*e* are formed at both longitudinal ends, the second cut grooves 32*c* each having a substantially U-shape in a plan view, extending from both ends in a direction approaching each other, and penetrating from an upper end surface 32*a* to a lower end surface 32*b*, the fifth through holes 32*e* penetrating from the surface in contact with the surface member 31 in a direction of the second back surface 32*d* on the opposite side. First fitting grooves 32*f* are formed in the upper and lower end surfaces of the joint member 32 in contact with the stud 33, and the upper and lower ends of the studs 33 can be fitted into the grooves. A length L1 of the joint member 32 illustrated in FIG. 5 is formed to be shorter than a first distance L2 from the first side surface 11*a* of the one wooden column 11 to the second side surface 12*a* of the other wooden column 12 illustrated in FIG. 3, and is desirably formed to be shorter by about 10 mm than the first distance L2, for example. With such a length, the joint member 32 can be easily installed on the pair of wooden columns 1.

As illustrated in FIGS. 5 and 9, the stud 33 is a vertical member disposed substantially at the widthwise center of each surface member 31, and is a member fixed to the one plate surface 31*a* with the locking tools 92 or the like to reinforce the surface member 31. The upper and lower ends of the stud 33 in contact with the joint member 32 are fitted into the first fitting grooves 32*f* of the joint portion 32, and an L-angle 33*a* is fixed with screws to an inner corner part of the side surface of the upper stud 33 and the joint member 32 to be integrally connected with the joint member 32. The lower frame member 34 is a horizontal member fixed to the lower end of the lower surface member 31, and is fixed to the one plate surface 31*a* of the surface member 31 with the locking tools 92, and the lower end of the lower stud 33 is fitted into a second fitting groove 34*a* formed in the upper end surface of the lower frame member 34. When the span between the pair of wooden columns 1 exceeds 1000 mm, as illustrated in FIG. 6, the wall panels 3 can be horizontally connected to each other with half-columns 35 that are vertical members. The width of the wall panel 3 is desirably set to be compatible with the bearing wall 4 having a span between columns of 2000 mm or less, and with such a width, the wall panels 3 pre-set at the factory can be stacked flat and transported by a small truck (about 4 tons).

In the present embodiment, the surface members 31 are vertically connected and fixed with the joint members 32, and the entire area surrounded by the pair of wooden columns 1 and wooden beams 2 is covered with the wall panel 3. However, as shown in FIG. 7A, the joint member 32 may be fixed to the upper end or the lower end of the surface member 31, and the plurality of wall panels 3 may be vertically spaced between the pair of wooden columns 1 to form an opening O therebetween. In this case, the joint member 32 can be used as a window sill or a window lintel of the opening O.

As illustrated in FIG. 4, the first joint metal fitting 7 is a substantially U-shaped metal fitting for fixing one longitudinal end of the wooden beam 2 to the one wooden column 11. The first joint metal fitting 7 is made up of a first contact portion 7*a* fixed to the first side surface 11*a* of the one wooden column 11 with bolts 93, and a pair of first insertion portions 7*b* projecting from both widthwise ends of the first contact portion 7*a* toward the other wooden column 12 and inserted into the first cut groove 2*a* of the wooden beam 2. The first contact portion 7*a* and the first insertion portion 7*b* have substantially the same height as that of the wooden beam 2. The first contact portion 7*a* is formed with a sixth through hole 7*c* penetrating in the thickness direction at a position that coincides with the first through hole 11*b* of the one wooden column 11 illustrated in FIG. 3A. The tip of each of the first insertion portions 7*b* is formed with a seventh through hole 7*d* penetrating in the thickness direction at a position that coincides with the fourth through hole 2*d* of the wooden beam 2 when inserted into the wooden beam 2.

A second joint metal fitting 8 illustrated in FIG. 8 is a metal fitting for joining the joint member 32 of the wall panel 3 to each of the pair of wooden columns 1, and is formed in a substantially U-shape in the same manner as the first joint metal fitting 7 described above. The second joint metal fitting 8 is made up of a second contact portion 8*a* that is fixed to each of the side surfaces, facing each other (the first side surface 11*a* in the illustrated example), of the pair of wooden columns 1 with bolts 93, and a pair of second insertion portions 8*b* that project from both widthwise ends of the second contact portion 8*a* toward the facing wooden column and are inserted into the second cut groove 32*c* of the joint member 32. The second contact portion 8*a* and the second insertion portion 8*b* have substantially the same height as that of the joint member 32. An eighth through hole 8*c* penetrating in the thickness direction is formed in the second contact portion 8*a* at a position that coincides with the second through hole 11*c* and the third through hole 12*b* formed in each of the wooden columns 11, 12 illustrated in FIG. 3. A ninth through hole 8*d* penetrating in the thickness direction is formed at the tip of each of the second insertion portions 8*b* at a position that coincides with the fifth through hole 32*e* of the joint member 32 when inserted into the joint member 32.

Next, an installation and construction method for the bearing wall 4 will be described. First, as illustrated in FIG. 9, the first joint metal fitting 7 and the second joint metal fitting 8 are installed on the pair of wooden columns 1 erected on the concrete foundation 5 placed at a construction site. As for the first joint metal fitting 7, as illustrated in FIG. 4, the first joint metal fitting 7 is installed on the one wooden column 11 by bringing the first contact portion 7*a* of the first joint metal fitting 7 into contact with the first side surface 11*a* of the one wooden column 11, penetrating the one wooden column 11 and the first contact portion 7*a* with the bolt 93 in a state where the first through hole 11*b* illustrated in FIG. 3A is aligned with the sixth through hole 7*c*, and fastening with a nut 94. As for the second joint metal fitting 8, as shown in FIGS. 2 and 8, the second joint metal fitting 8 is installed on the pair of wooden columns 1 by bringing the second contact portion 8*a* on each of the side surfaces 11*a*, 12*a*, facing each other, of the pair of wooden columns 1, penetrating each of the wooden columns 11, 12 and the second contact portion 8*a* with the bolt 93 in a state where each of the through holes 11*c*, 12*b* formed in the wooden columns 11, 12 is aligned with the eighth through hole 8*c*, and fastening with the nut 94.

Subsequently, as illustrated in FIG. 9, the joint member 32 of the wall panel 3 is dropped from above the second joint metal fitting 8, the second insertion portion 8*b* of the second joint metal fitting 8 is inserted into the second cut groove 32*c*, the fifth through hole 32*e* and the ninth through hole 8*d* of the second insertion portion 8*b* are penetrated with the drift pin 91 from the second back surface 32*d* side of the joint member 32 illustrated in FIG. 8, and the joint member 32 is locked to the pair of wooden columns 1 as illustrated in FIG. 9. As described above, since the joint member 32 is formed to have a smaller length than the first distance L2 between the pair of wooden columns 1, the joint member 32 can be easily installed between the pair of wooden columns 1. Further, since the second joint metal fitting 8 is installed on each of the wooden columns 11, 12 before the installation of the wall panel 3, the joint member 32 can be easily positioned, and since the second cut groove 32*c* of the joint member 32 is penetrated from the upper end surface to the lower end surface, the joint member 32 can be easily fitted into the second joint metal fitting 8 only by being dropped from above the second joint metal fitting 8. At this stage, the wall panel 3 is in a state where the joint member 32 is only locked to each of the wooden columns 11, 12, and the surface member 31 is not fixed to each of the wooden columns 11, 12.

Next, as illustrated in FIG. 4, the first contact portion 7*a* of the first joint metal fitting 7 installed in the pair of wooden columns 11 is inserted into the first cut groove 2*a* of the wooden beam 2, the fourth through hole 2*d* and the seventh through hole 7*d* of the first insertion portion 7*b* are penetrated from the first back surface 2*c* side of the wooden beam 2 with the drift pin 91 to lock one longitudinal end of the wooden beam 2 to the one wooden column 11, and the dowel 2*e* projecting from the lower end of the wooden beam 2 is inserted into the dowel hole 12*b* of the other wooden column 12 to install the wooden beam 2 between the pair of the wooden columns 1. In the present embodiment, the wooden beam 2 is installed on each of the wooden columns 11, 12 by using the first joint metal fitting 7 and the dowel 2*e*, but other metal fittings may be used so long as the wooden beams 2 can be installed.

The pair of wooden columns 1 erected on the foundation 5 are affected by the construction accuracy of the upper end surface of the foundation 5 formed at the construction site, and hence the pair of wooden columns 1 need to be subjected to erection adjustment at the stage where the wooden beam 2 is installed therebetween. At this time, as described above, although the joint member 32 of the wall panel 3 is locked to the pair of wooden columns 1 by the second joint metal fitting 8, the surface member 31 is not fixed to each of the wooden columns 11, 12 and is not connected to the wooden beam 2. Therefore, the movements of each of the wooden columns 11, 12 and the wooden beam 2 are not inhibited by the wall panel 3, and the erection adjustment of each of the wooden columns 11, 12 can be performed smoothly. Further, since the frame of the wooden beam 2 is not restricted by the wall panel 3, it is possible to maintain the degree of freedom in design, such as laying another wooden beam or a horizontal member on the wooden beam 2. After the erection adjustment of each of the wooden columns 11, 12 is completed, as shown in FIG. 11, the surface member 31 of the wall panel 3 is finally fixed to the respective front surfaces 11*d*, 12*c* of the pair of wooden columns 1 and the front surface 2*b* of the wooden beam 2 with the locking tools 92, to complete the bearing wall 4.

As illustrated in FIGS. 7A and 7B, when the opening O is provided at the upper or lower portion of the wall panel 3, it is desirable that each longitudinal end of the joint member 32 be spaced from each of the first side surface 11*a* and the second side surface 12*a* by a predetermined distance to form a gap S. Generally, when the opening O is provided between the pair of wooden columns 1, the part of each of the wooden columns 11, 12 which faces the opening O and to which the surface member 31 is not fixed has lower rigidity than the part of each of the wooden columns 11, 12 to which the surface member 31 is fixed, and has a large amount of vertical displacement when receiving a horizontal force. Thus, when a horizontal force acts on the pair of wooden columns 1, each of the wooden columns 11, 12 facing the opening O is likely to buckle because a shear compressive force is transmitted to a part intersecting with the joint member 32. However, by forming the gap S as thus described, it is possible to prevent to some extent each of the wooden columns 11, 12 facing the opening O from being strongly pressed against the edge of the joint member 32 and buckling in a brittle manner. Further, a separation distance L3 between the edge of the joint member 32 and each side surface (the second side surface 12*a* in the illustrated example) of each of the wooden columns 11, 12 illustrated in FIG. 7B is preferably about 5 mm. This distance can reduce the possibility that the wooden columns 11, 12 facing the opening O buckle in a brittle manner.

As thus described, in the wall panel installation and construction method of the present application, since the wall panel 3 does not obstruct the movement of the framing member, the framing of the pair of wooden columns 1 and the wooden beams 2, the erection adjustment of each of the wooden columns 11, 12, and the construction of the wall panel 3 can be performed at the same timing, and the outdoor work time easily affected by weather can be shortened. Since the joint member 32 is joined to the pair of wooden columns 1 with the second joint metal fittings 8, the wall panel 3 can be easily positioned as compared to the case of fixing the wall panel 3 to each of the wooden columns 11, 12 only with nails or screws, thereby improving the attachment accuracy. Further, the wall panel installation and construction method of the present invention is applicable not only to the case of forming a bearing wall on the outer periphery of a building but also to the case of forming a bearing wall and a partition wall inside a building, and can thus be a construction method excellent in convenience.

Embodiments of the present invention are not limited to the above-described embodiments, and appropriate modifications can be made without departing from the scope of the concept of the present invention.

INDUSTRIAL APPLICABILITY

An installation and construction method of a wall panel according to the present invention can be favorably used when a bearing wall of a building outer peripheral portion is formed.

DESCRIPTION OF REFERENCE SIGNS

1 a pair of wooden columns
11 each of the wooden columns
11*a* first side surfaces of each of the wooden columns
12 the other wooden columns
12*a* the second side surface of the other wooden columns
2 wooden beam
3 a wall panel
31 surface member
32 joint member
32*a* upper end surface (of the joint member)
32*b* lower end surface (of the joint member)
32*c* second cut groove (cut groove)
33 stud
34 lower frame member
8 second joint metal fitting (joint metal fitting)

The invention claimed is:

1. A wall panel installation and construction method for installing a wall panel on a pair of wooden columns spaced from each other by a distance and a wooden beam installed between the pair of wooden columns, the wall panel including a surface member and a joint member, the joint member extending horizontally and being fixed to one plate surface of the surface member, the pair of wooden columns having side surfaces facing each other, the wall panel installation and construction method comprising:

disposing the wall panel with the joint member being positioned between the pair of wooden columns, with each longitudinal end of the joint member being spaced by a predetermined distance from a corresponding one of the side surfaces of the pair of wooden columns to form a corresponding gap;

joining each of the longitudinal ends of the joint member to the corresponding one of the side surfaces of the pair of wooden columns;

installing the wooden beam between the pair of wooden columns; and after the joining of the longitudinal ends of the joint member and the installing of the wooden beam, moving at least one of the wooden columns within the corresponding gap to adjust an orientation of the at least one of the wooden columns relative to the surface member of the wall panel; and after the moving of the at least one of the wooden columns within the corresponding gap, fixing an edge of the surface member to front surfaces of the pair of wooden columns and the wooden beam.

2. The wall panel installation and construction method according to claim 1, wherein a joint metal fitting is fixed to each of the side surfaces, facing each other, of the pair of wooden columns, and the joint member is joined to the pair of wooden columns by inserting an insertion portion of the joint metal fitting into each of cut grooves formed at both longitudinal ends of the joint member, and penetrating the joint member with a drift pin along with the insertion portion.

3. The wall panel installation and construction method according to claim 2, wherein the wall panel disposed in an upper or a lower portion of an opening provided between the pair of wooden columns is formed by fixing the joint member to an upper end or a lower end facing the opening of the surface member.

4. The wall panel installation and construction method according to claim 2, wherein the cut groove is formed to penetrate the joint member from an upper end surface to a lower end surface of the joint member.

5. The wall panel installation and construction method according to claim 2, wherein the wall panel comprises a plurality of surface members and the joint member, and is formed by connecting and fixing each of the surface members, adjacent vertically, with the joint member.

6. The wall panel installation and construction method according to claim 1, wherein the wall panel comprises a plurality of surface members and the joint member, and is formed by connecting and fixing each of the surface members, adjacent vertically, with the joint member.

7. The wall panel installation and construction method according to claim 1, wherein the wall panel further includes a stud and a lower frame member that are fixed to a plate surface of the surface member on a side where the joint member is fixed and reinforce the surface member.

* * * * *